United States Patent [19]

Baldwin

[11] Patent Number: 4,955,280

[45] Date of Patent: Sep. 11, 1990

[54] AMMUNITION TRANSFER APPARATUS

[75] Inventor: William C. Baldwin, Costa Mesa, Calif.

[73] Assignee: North American Dynamics, Tustin, Calif.

[21] Appl. No.: 403,619

[22] Filed: Sep. 6, 1989

[51] Int. Cl.[5] ..... F41A 9/31; F41A 9/37

[52] U.S. Cl. ..... 89/33.04; 89/33.25; 89/36.13

[58] Field of Search ..... 89/33.04, 33.16, 33.25, 89/36.13

[56] References Cited

U.S. PATENT DOCUMENTS

| | | | |
|---|---|---|---|
| 4,494,440 | 1/1985 | Koine | 89/33.04 |
| 4,574,685 | 3/1986 | Sanborn et al. | 89/36.13 |
| 4,665,793 | 5/1987 | Cleary et al. | 89/33.04 |
| 4,781,100 | 11/1988 | Baldwin | 89/33.04 |

*Primary Examiner*—Stephen C. Bentley

*Attorney, Agent, or Firm*—Price, Gess & Ubell

[57] ABSTRACT

A universal gun mount and ammunition feed system wherein an M242 chain gun is disposed with its dual feed chutes vertically oriented and fed with a symmetrical dual feed arrangement wherein linked rounds are rotated 180 degrees and wherein flex chuting is mounted about the sides of the turret and extends upwardly into the feed mechanism, thereby preventing binding, excessive loading, and jamming.

17 Claims, 3 Drawing Sheets

AMMUNITION TRANSFER APPARATUS

BACKGROUND OF THE INVENTION

1. Field of the Invention

The subject invention relates to gun mounts and, more particularly, to a universal gun mount featuring a rotated version of the M242 25 mm Bushmaster chain gun with an improved linked ammunition feed system.

2. Description of Related Art

A typical linked ammunition firing gun in the U.S. arsenal is the M242 25 mm Bushmaster chain gun. The gun may be turret mounted in an infantry fighting vehicle and has a dual feed apparatus for alternatively feeding high explosive (HE) or armor piercing (AP) rounds into the gun for firing. In this operation, two bands of ammunition, HE and AP, must be simultaneously provided to the feeder apparatus during operation of the gun.

In the M242 chain gun, linked ammunition supplies the HE and AP rounds. Linked ammunition is ammunition held together by coupling devices (links) which enables the ammunition to be pulled into the gun's receiver as it is fired.

The M242 chain gun has typically been mounted in a turret such that the linked ammunition belts feed up and into the gun at an angle as illustrated, for example, in U.S. Pat. No. 4,781,100. In this position, the feed paths of the feeder assembly are approximately horizontal and accept the ammunition from the left-hand side of the weapon.

It has appeared desirable to provide a universal gun mount employing the M242 chain gun which could be mounted on various types of wheeled and tracked vehicles. However, attempts to provide such a universal mount have encountered difficulties, particularly in achieving satisfactory feeding of the linked ammunition to the gun.

The linked ammunition is typically fed to the M242 chain gun through so-called flex chuting. This chuting presents difficulties to reorienting the gun with respect to its mounting in that flex chuting is relatively inflexible and presents difficulties in changing feed angles. A particular difficulty is that, as the gun is elevated or depressed, the flex chuting is subjected to severe twisting, and thus becomes bound and causes excessive loading, affecting the gun rate and potentially jamming the system.

SUMMARY OF THE INVENTION

Accordingly, it is an object of the invention to provide an improved gun mount;

It is another object of the invention to provide a universal gun mount for the M242 chain gun; and It is still another object of the invention to alter the ammunition feed angle to the gun while maintaining reliable feeding and firing of the ammunition.

These and other objects of the invention are achieved by providing a universal gun mount wherein the M242 chain gun is disposed with the feed chutes of the feeder assembly rotated to a vertical position. Flex chute fed ammunition enters symmetrically on either side of the gun into respective rotors, which feed the ammunition into the gun. The ammunition may thus be looped 180 degrees, while the flex chuting is advantageously positioned down and around the sides of the universal mount, preventing binding, excessive loading, and jamming.

BRIEF DESCRIPTION OF THE DRAWINGS

The just-summarized invention will now be described in conjunction with the drawings, of which.

DESCRIPTION OF THE PREFERRED EMBODIMENTS

Figure 1:
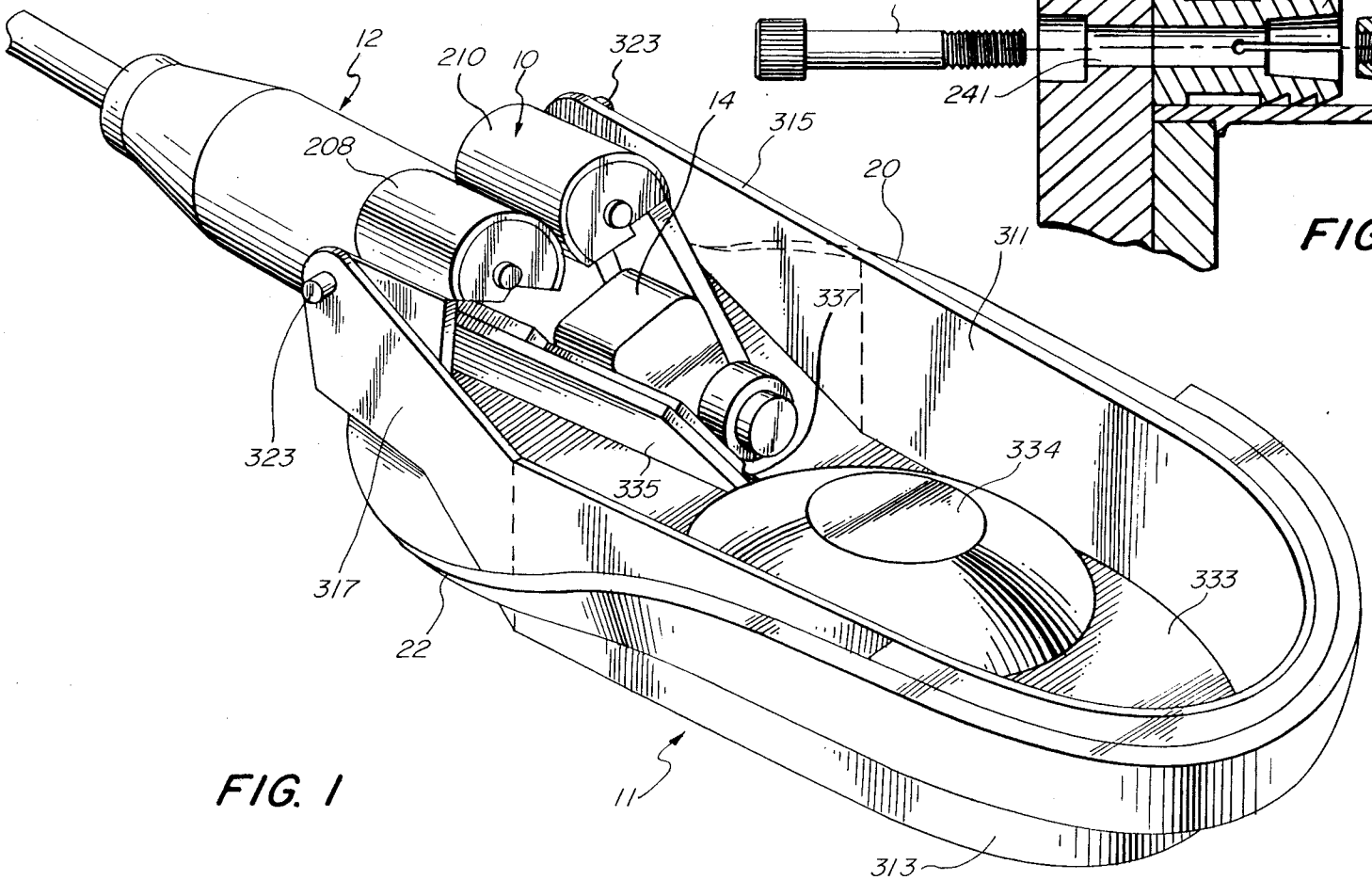
FIG. 1 is a perspective view of the preferred embodiment of the invention.

As shown in FIG. 1, the universal gun mount of the preferred embodiment includes a turret 11 for mounting an M242 chain gun 12. The turret 11 may be disposed in a rotatable or fixed manner on a variety of fighting vehicles by making it adaptable to the cupola ring of the M113 armored personnel carrier.

The turret 11 has a side panel 311 which is generally U-shaped at its rear 313. First and second mounting arms 315, 317 extend slightly inwardly and upwardly from each side of the U-shaped side panel 311. The arms 315, 317 each include a hole for receiving a trunnion mounting 323 which pivotally mounts the M242 chain gun 12 between the first and second mounting arms 315, 317.

The turret 11 further includes a flat bottom portion 333 containing a cupola hatch 334. The bottom portion 333 is welded or otherwise attached to the lower edge of the side panel 311 and to the lower edge of the mounting arms 315, 317. The bottom 333 thus extends upwardly in conformance with the bottom edges of the arms 315, 317. A space is left between the gun 12 and the bottom 333 of the turret 11 such that the gun 12 may tilt upwardly about 60 degrees and down 20 degrees before it contacts the bottom 333.

The M242 gun 12 includes first and second plates 335, 337 which those skilled in the art will recognize as constituting the interface between the receiver and feeder.

First and second flex chutes 20, 22 are wrapped around the side panel 311 of the turret 11 and fastened thereto by suitable brackets (not shown). Each flex chute 20, 22 curves underneath a respective mounting arm 315, 317, upwardly inside the respective mounting arms 315, 317, and then enters a respective ammunition feed housing 208, 210.

The feed housings 208, 210 are part of an ammunition transfer unit 10. The ammunition transfer unit 10 is mounted to the feeder assembly 14, which is part of the standard M242 gun. According to the preferred embodiment, this mounting is achieved without significant modification to the standard feeder assembly 14 of the M242 gun. The transfer unit 10 further provides for the releasable attachment of flex chutes 20, 22, to enable in-field separation thereof for maintenance and service of the feeder assembly 14, as will be hereinafter described in greater detail.

Figure 2:
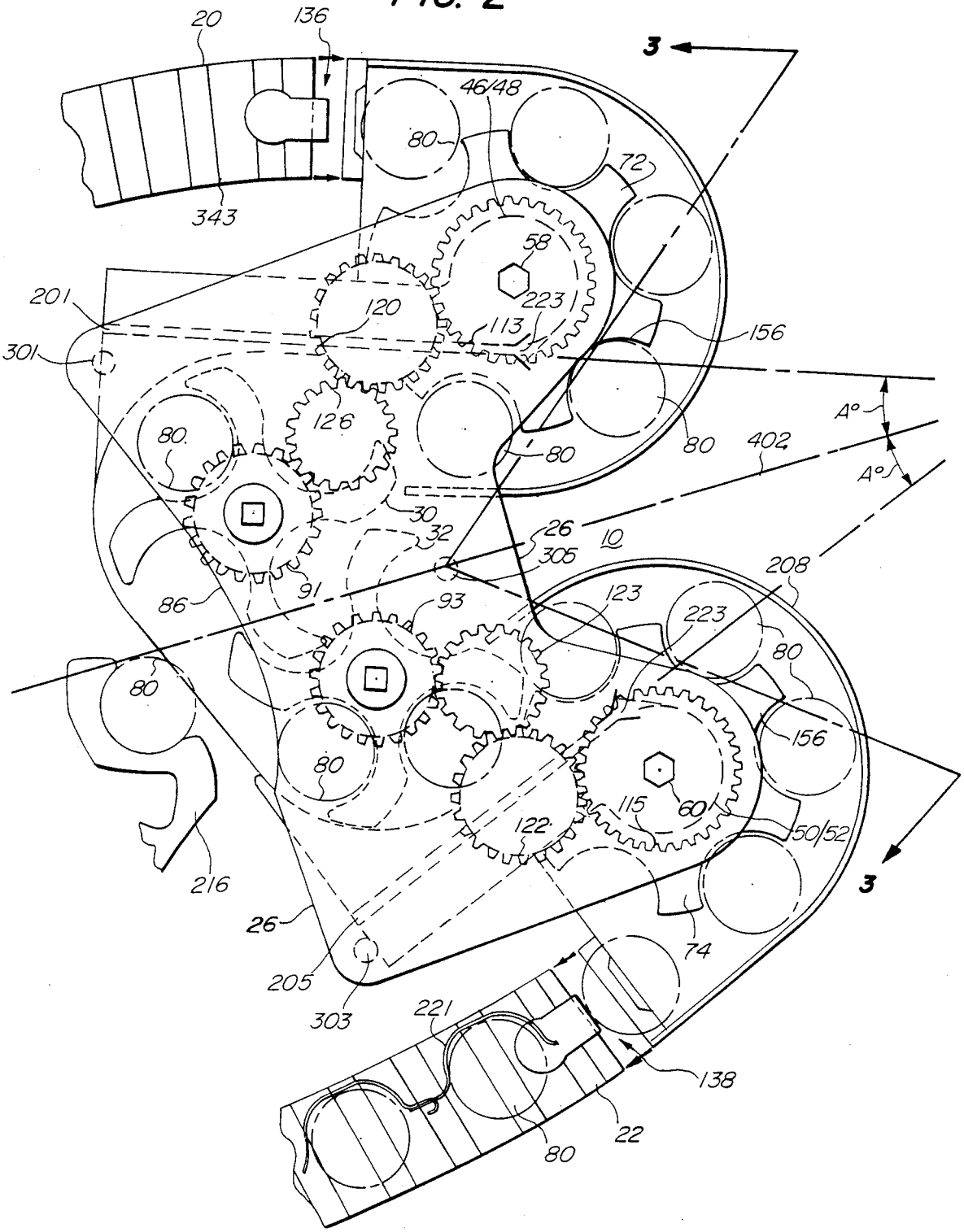
FIG. 2 is a front schematic view of the ammunition feed apparatus of the preferred embodiment looking down the barrel.
Figure 3:
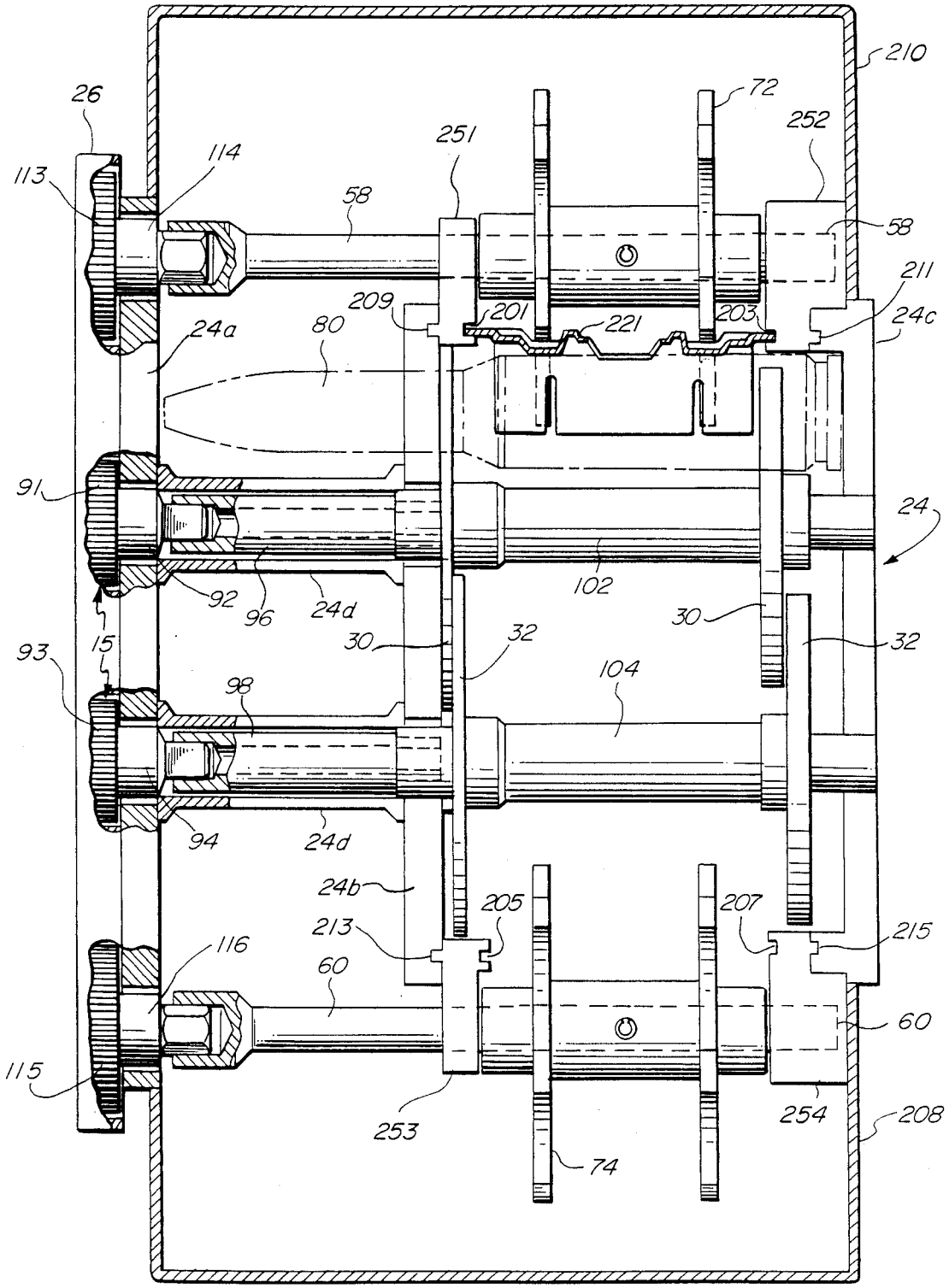
FIG. 3 is a partially broken away sectional view taken at 3—3 of FIG. 2.

Turning to FIGS. 2 and 3, the ammunition transfer unit 10 generally includes a drive train indicated generally at 15 in FIG. 3. The drive train 15 is supported by a housing 24, to which is attached an end plate 26. The housing 24 includes first, second, and third parallel plates 24*a*, 24*b*, 24*c*. These plates 24*a*, 24*b*, 24*c* are all part of the conventional ammunition feed assembly 14 of the M242 gun. In this assembly 14, the plates 24*a*, 24*b*, 24*c* are held apart by welded standoffs such as shown at 24*d* in FIG. 3. Other than as discussed herein, the conventional feed assembly of the M*242* gun is not altered in the preferred embodiment.

The end plate 26, which is added according to the preferred embodiment, is visible when looking at the gun 12 of FIG. 1 in a direction "down the barrel." The end plate 26 serves as a gear train housing and is attached to the housing plate 24*a* at anchor points 301, 303, 305 (FIG. 2). These anchor points 301, 303, 305 correspond to interior cylindrical openings provided by standoffs in the conventional M242 housing, as will be described in more detail below.

The drive train 15 provides means for transferring a drive from ammunition feed sprockets 30, 32 disposed in the conventional ammunition feeder assembly 14 to ammunition transfer sprockets 72, 74 added according to the preferred embodiment. The drive train 15 includes two power takeoff spindles 92, 94, each having a gear 91, 93, respectively, integrally formed therewith. Takeoff shafts 96, 98 are connected to the takeoff spindles 92, 94, respectively, for fixedly engaging feed sprocket shafts 102, 104, respectively, through the front housing 24*b*. The feed sprocket shafts 102, 104 are part of the conventional feeder assembly 14 and are coupled, respectively, to the ammunition feed sprockets 30, 32, which are power driven by the feeder assembly 14. It should be appreciated that the takeoff shafts 96, 98 may be configured in any suitable fashion to engage feed sprocket shafts 102, 104.

Power taken from the shafts 102, 104 by the takeoff shafts 92, 94 is transmitted through respective AP and HE gear trains to transfer sprocket spindles 114, 116 for driving the ammunition transfer sprockets 72, 74, in order to move ammunition through the feed chutes 20, 22. The AP gear train includes two gears 120, 126, and the HE gear train includes two gears 122, 123. The gear ratio between gears 91 and 120 is 1 to 1, while that between gears 120 and 113 is 1.5 to 1.

In order to conserve space, the AP and HE gear trains are disposed in cutouts in the front plate 26, and include a multiple number of idler gears 120, 126, 122, 123. This design assists in confining the overall shape of the plate 26 to within the overall dimensions of the front housing 24. The gears 113, 115 integrally formed on the respective transfer sprocket spindles 114, 116 mesh with the idler gears 120, 122, respectively. The transfer sprocket spindles 114, 116 are further connected to sprocket drive shafts 58, 60, which drive the transfer sprockets 72, 74.

The AP and HE drive trains are configured for enabling appropriate rotational speeds of the transfer sprocket spindles 114, 116 and transfer sprockets 72, 74 to enable transfer of link-ammunition 80 between the transfer sprockets 72, 74 and the ammunition feed sprockets 30, 32 when the feed chutes 20, 22 are coupled to the feeder assembly 14. In particular, the spindles 114, 116 are provided with a hex drive, while the spindles 92, 94 are provided with a square drive such that a 4:6 drive ratio is provided. This drive ratio enables the transfer of linked bullets by transfer sprockets 72, 74 to feed sprockets 30, 32.

Also provided in the preferred embodiment are bearing support members 252, 251, 254, 253 (FIG. 3). The support members 252, 251, 254, 253 are each unitary members having respective linear link stripper grooves 201, 203, 205, 207, and respective tongues 209, 211, 213, 215. The tongues 209, 211, 213, 215 fit in respective grooves already present in the M242 housing plates 24*b*, 24*c* and assist in retaining the support members 251, 252, 253, 254 which are bolted to the respective housing plates 24*b*, 24*c*. The screws which attach the link-strippers within the conventional feeder 14 are reused for this bolting.

The support members 251, 252, 253, 254 each contain a bearing for mounting shafts 58, 60 of the transfer apparatus. The first pair of support members 254, 253 each contain a bearing for mounting shaft 60, while the second pair of support members 252, 251 contain bearings for mounting shaft 58.

The respective link stripper grooves 201, 203, 205, 207 perform the link stripping function. FIG. 3 particularly illustrates a conventional link 221 with its ends engaging grooves 201, 203 of support members 252, 251. As sprocket 30 feeds round 80 into sprocket 216, the grooves 201, 203 strip the link 221 from the round 80. As shown in FIG. 2, the grooves 201, 203, 205, 207 each have a V-shaped entryway 223 to pick up and introduce the link 221. The link 221 is removed and guided down the grooves 201, 203 and out of the feeder 14.

Each of the flex chutes 20, 22 contain a plurality of interconnected links 221 (see FIG. 2), as known in the art. FIG. 2 shows the conventional snap fittings 136, 138 of the feed chutes 20, 22, respectively. These snap fittings 136, 138 provide quick attachment and detachment of the flex chutes 20, 22 to the housings 208, 210. The link elements 221 engage and are driven by arcuate portions 156 of the transfer sprockets 72, 74.

The transfer sprockets 72, 74 pass the linked ammunition rounds 80 into the feed sprockets 30, 32, respectively. The feed sprockets 30, 32 delink and pass the ammunition rounds 80 to a chamber sprocket 216, which positions the ammunition rounds 80 for firing by the gun 12. During this transfer of rounds 80, the links 221 are stripped by the grooves 201, 203, 205, 207 in the bearing support blocks 251, 252, 253, 254, as described above. The feed sprockets 72, 74 thus control the rounds 80 such that they are properly led into the link stripping apparatus and the feed sprockets 30, 32.

It will be appreciated from FIG. 2 that when the feed housings 208 and 210 are uncoupled from the feeder assembly 14, the feed sprockets 72, 74 are readily accessible, thereby enabling removal of ammunition therefrom to gain access to chamber portions of the gun (not shown).

It will be appreciated that the M242 feeder assembly 14 is not a part of the present invention; however, according to the preferred embodiment, it is adapted to receive ammunition rounds alternately from two flex chutes 20, 22 such that the rounds are rotated substantially 180 degrees before entering the gun. As can be further appreciated from FIG. 2, the preferred embodiment provides feed sprockets 72, 74 which are symmetrically disposed about the vertical, indicated by line 402, in a generally symmetrical dual feed arrangement. Line 402 itself bisects the acute angle along which lie the sides of the respective feed chutes 201, 205. These feed chutes are each parallel to a respective groove 209, 213 in the conventional M242 housing.

Figure 4:
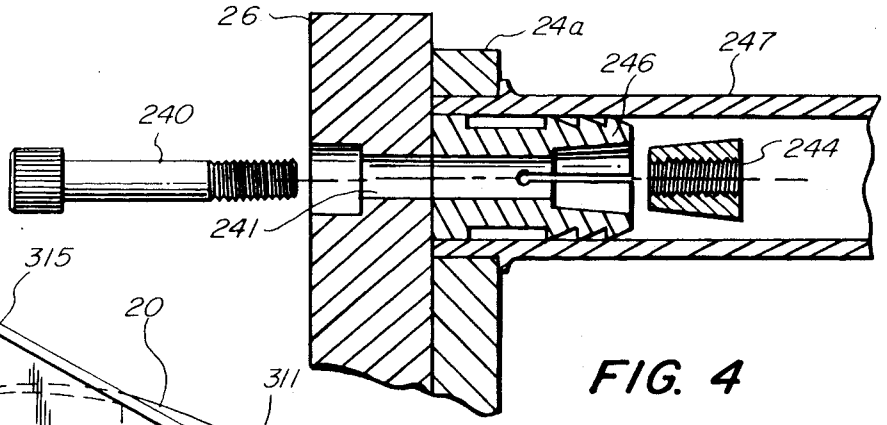
FIG. 4 is a side schematic view illustrating a plate connection detail according to the preferred embodiment.

FIG. 4 illustrates a plate connector detail of the preferred embodiment for connecting plates 24*a* and 26. As shown, a bolt 240 is inserted through hole 241 drilled in the plate 26. The bolt 240 threads into and pulls a cone-shaped plug 244 into a split collet 246, expanding the collet 246 to cause it to fixedly engage the interior wall of a standoff 247, which is part of the conventional M242 gun feeder assembly.

Numerous adaptations and modifications of the just-disclosed preferred embodiment will be apparent to those skilled in the art from the above disclosure. Therefore, it is to be understood that, within the scope of the appended claims, the invention may be practiced other than as specifically described herein.

What is claimed is:

1. Automatic weapon apparatus comprising:

an M242 gun having a dual feed apparatus, including first and second ammunition feed sprockets having respective receptacles for receiving rounds of ammunition;

turret means for mounting said gun with said dual feed apparatus rotated substantially vertical, said turret means including first and second sides and first and second mounting arms extending from said first and second sides, respectively;

dual ammunition feed means synchronized with said dual feed apparatus for receiving first and second supplies of linked rounds fed generally upwardly on either side of said gun, respectively, and for rotating said rounds substantially 180 degrees to enter the vertical dual feed apparatus from either side of said gun and for guiding each round into a respective receptacle, thereby positively controlling feeding of ammunition into said dual feed apparatus; and first and second flex chutes connected to said ammunition feed means for supplying said linked rounds, each said flex chute being wrapped around a respective said side of said turret means and extending upwardly within one of said arms to connect to said ammunition feed means.

2. The apparatus of claim 1 wherein said dual ammunition feed means comprises:

first and second ammunition transfer sprockets for receiving said linked rounds; and drive means for transferring drive to said first and second ammunition transfer sprockets from said dual feed apparatus.

3. The apparatus of claim 2 wherein said drive means comprises:

first and second spindle means, each for providing a square drive;

third and fourth spindle means, each for providing a hex drive for driving a respective one of said first and second ammunition transfer sprockets; and gear means for transferring a drive between said first and third spindle means and between said second and fourth spindle means.

4. The apparatus of claim 3 wherein said dual ammunition feed means further comprises first, second, third and fourth support member means attached to said dual feed apparatus, each containing a link stripper groove and a bearing for a shaft.

5. The apparatus of claim 1 wherein said first and second flex chutes are respectively disposed such that they lie along respective lines forming equal angles with the vertical.

6. Automatic weapon apparatus comprising:

aN M242 gun having a dual feed apparatus;

turret means for mounting said gun with said dual feed apparatus rotated substantially vertical, said turret means including first and second sides and first and second mounting arms extending from said first and second sides, respectively;

dual ammunition feed means for receiving first and second supplies of linked rounds fed generally upwardly on either side of said gun, respectively, and for rotating said rounds substantially 180 degrees to enter the vertical dual feed apparatus from either side of said gun; and first and second flex chutes connected to said ammunition feed means for supplying said linked rounds, each said flex chute being wrapped around a respective said side of said turret means and extending upwardly within one of said arms to connect to said ammunition feed means.

7. Automatic weapon apparatus comprising:

an M242 gun having a dual feed apparatus including first and second ammunition feed sprockets;

turret means for mounting said gun with said dual feed apparatus rotated substantially vertical; and dual ammunition feed means for receiving first and second supplies of linked rounds fed generally upwardly on either side of said gun, respectively, and for rotating said rounds substantially 180 degrees to enter the vertical dual feed apparatus from either side of said gun, said dual ammunition feed means comprising:

first and second transfer sprockets for receiving said linked rounds and supplying them respectively to said first and second ammunition feed sprockets; and drive means for transferring drive to said first and second transfer sprockets from said dual feed apparatus.

8. The weapon apparatus of claim 7 wherein said turret means includes first and second sides and first and second mounting arms extending from said first and second sides, respectively.

9. The weapon apparatus of claim 7 further including first and second flex chutes connected to said ammunition feed means for supplying said linked rounds.

10. The apparatus of claim 9 wherein each flex chute is wrapped around a respective said side of said turret means and extends upwardly within one of said arms to connect to said ammunition feed means.

11. The apparatus of claim 7 wherein said drive means comprises:

first and second spindle means, each for providing a square drive;

third and fourth spindle means, each for providing a hex drive for driving a respective one of said first and second transfer sprockets; and gear means for transferring a drive between said first and third spindle means and between said second and fourth spindle means.

12. The apparatus of claim 11 wherein said dual ammunition feed means further comprises first, second, third and fourth support member means attached to said dual feed apparatus, each containing a link stripper groove and a bearing for a shaft.

13. The apparatus of claim 12 wherein said dual feed apparatus contains first and second ammunition feed chutes and wherein said feed chutes are respectively disposed such that they lie along respective lines forming equal angles with the vertical.

14. Automatic weapon apparatus comprising:

a gun having a dual feed apparatus including first and second ammunition feed sprockets;

turret means for mounting said gun with said dual feed apparatus rotated substantially vertical; and dual ammunition feed means for receiving first and second supplies of linked rounds fed generally upwardly on either side of said gun, respectively, and for rotating said rounds substantially 180 degrees to enter the vertical dual feed apparatus from either side of said gun, said dual ammunition feed means comprising:

first and second transfer sprockets for receiving said linked rounds and supplying them respectively to said first and second ammunition feed sprockets; and drive means for transferring drive to said first and second transfer sprockets from said dual feed apparatus.

15. The apparatus of claim 14 wherein said drive means comprises:

first and second spindle means, each for providing a square drive;

third and fourth spindle means, each for providing a hex drive for driving a respective one of said first and second sprockets; and gear means for transferring a drive between said first and third spindle means and between said second and fourth spindle means.

16. The apparatus of claim 15, wherein said dual ammunition feed means further comprises first, second, third and fourth support member means attached to said dual feed apparatus, each containing a link stripper groove and a bearing for a shaft.

17. The apparatus of claim 16 wherein said dual feed apparatus contains first and second ammunition feed chutes and wherein said feed chutes are respectively disposed such that they lie along respective lines forming equal angles with the vertical.

* * * * *